US008997679B2

(12) United States Patent
Ricci

(10) Patent No.: US 8,997,679 B2
(45) Date of Patent: Apr. 7, 2015

(54) PLEASURE BOAT

(75) Inventor: Mauro Ricci, Rimini (IT)

(73) Assignee: Enrico Giovanni Puppi, Cassola (VI) (IT)

( * ) Notice: Subject to any disclaimer, the term of this patent is extended or adjusted under 35 U.S.C. 154(b) by 29 days.

(21) Appl. No.: 13/988,188

(22) PCT Filed: Nov. 17, 2011

(86) PCT No.: PCT/IB2011/055146

§ 371 (c)(1),
(2), (4) Date: May 17, 2013

(87) PCT Pub. No.: WO2012/066496

PCT Pub. Date: May 24, 2012

(65) Prior Publication Data

US 2013/0233233 A1 Sep. 12, 2013

(30) Foreign Application Priority Data

Nov. 18, 2010 (IT) ..... RN2010A0073

(51) Int. Cl.

| | |
|---|---|
| ***B63B 17/00*** | (2006.01) |
| ***B63B 35/73*** | (2006.01) |
| ***B63H 16/20*** | (2006.01) |
| ***B63C 11/16*** | (2006.01) |

(52) U.S. Cl.

CPC ..... *B63B 35/73* (2013.01); *B63H 16/20* (2013.01); *B63C 11/16* (2013.01)

(58) Field of Classification Search

USPC ..... 114/343, 363; 4/487

See application file for complete search history.

(56) References Cited

U.S. PATENT DOCUMENTS

| | | | | | |
|---|---|---|---|---|---|
| 4,126,905 | A | * | 11/1978 | Russell et al. | 4/492 |
| 4,135,256 | A | * | 1/1979 | Limegrover | 4/487 |
| 4,149,281 | A | * | 4/1979 | Bob et al. | 4/487 |
| 4,152,791 | A | * | 5/1979 | Rose | 4/487 |
| 4,443,900 | A | * | 4/1984 | Remeyer | 4/492 |
| 4,542,854 | A | * | 9/1985 | Mathis | 239/428.5 |
| 4,754,502 | A | * | 7/1988 | Bowen | 4/487 |
| 4,853,987 | A | * | 8/1989 | Jaworski | 4/541.6 |
| 5,245,221 | A | * | 9/1993 | Schmidt et al. | 307/112 |
| 5,638,556 | A | * | 6/1997 | Kipers et al. | 4/488 |
| 6,795,983 | B2 | * | 9/2004 | Brown et al. | 4/487 |
| 7,032,258 | B2 | * | 4/2006 | O'Hanlon | 4/487 |

(Continued)

FOREIGN PATENT DOCUMENTS

| | | |
|---|---|---|
| FR | 2839333 A1 | 11/2003 |
| FR | 2853679 A1 | 10/2004 |

OTHER PUBLICATIONS

Choosing Cruising: "MS Galileo," Nov. 1, 2010, XP002648220, Retrieved from the Internet: URL:http://www.choosingcruising.co.uk/cruiseweb/ShpDetailsQuery.asp?client-choosing&nShp=504.

(Continued)

*Primary Examiner* — Lars A Olson
*Assistant Examiner* — Jovon Hayes
(74) *Attorney, Agent, or Firm* — Venable LLP; Robert Kinberg

(57) ABSTRACT

The present invention refers to a pleasure boat and particularly but not exclusively to a pedal boat. According to the invention, in order to make sea excursions with said pleasure boat more attractive, the boat comprises a jetted tub on board, preferably fed with seawater drawn directly from the surrounding environment.

15 Claims, 3 Drawing Sheets

(56) References Cited

U.S. PATENT DOCUMENTS

| | | | | |
|---|---|---|---|---|
| 8,117,729 | B2 * | 2/2012 | West | 29/469 |
| 2003/0228195 | A1 * | 12/2003 | Mizutani | 405/52 |
| 2004/0205888 | A1 * | 10/2004 | Mattson et al. | 4/541.1 |
| 2005/0198730 | A1 * | 9/2005 | Li | 4/496 |
| 2006/0015998 | A1 * | 1/2006 | Whitinger et al. | 4/545 |
| 2008/0201838 | A1 * | 8/2008 | West | 4/506 |
| 2013/0233233 | A1 * | 9/2013 | Ricci | 114/343 |
| 2014/0053769 | A1 * | 2/2014 | Karpenske | 114/363 |

OTHER PUBLICATIONS

International Search Report of PCT/IB2011/055146 mailed Mar. 28, 2012 with Written Opinion of the International Searching Authority.

* cited by examiner

PLEASURE BOAT

FIELD OF THE ART

The present invention refers to a pleasure boat.

Particularly, but not exclusively, the present invention refers to a pedal boat.

PRIOR ART

At seaside resort areas, small pleasure boats are often present and available to tourists for brief excursions.

Such pleasure boats can be of different type, and specifically they can provide for different propulsion means; for example, they can be pedal boats, rowboats, sailboats and motorboats.

For example, at Italian seaside resorts, particularly along the Adriatic coast, rowboats and, in recent times, pedal boats are quite widespread.

Pedal boats have been present for many decades at nearly all seaside resorts of the Adriatic coast and have been used by several generations of tourists.

Unfortunately, pedal boats and similar pleasure boats have lost their appeal over the years.

Even the recent introduction of electric pedal boats with assisted pedaling has not achieved the desired effect in terms of tourist popularity.

Indeed, as is well-known, tourists are mainly attracted by novelty and by current fads, and a conventional pastime like the pedal boat no longer elicits the same interest it used to.

In particular, in recent years there has been a great rise in popularity of all those activities linked to health—such as gyms, fitness centers, saunas and massage centers—even if they are often not at all connected to the seaside resort, to the beach or the sea.

The main object of the present invention is to make excursions in pedal boats and pleasure boats more attractive.

Another object of the present invention is to re-introduce the clientele of seaside tourist resorts to activities more closely correlated with the beach and the sea.

Further object of the present invention is to attain the abovementioned objects from a pleasure boat that is simple and inexpensive to make, such that it is competitive from an economical standpoint.

These and other objects are attained with a pleasure boat as claimed in the claims set.

DESCRIPTION OF THE INVENTION

Due to the fact that pleasure boat according to the invention comprises a jetted tub on board, preferably directly fed with seawater, users can combine the sea excursion with a relaxing, comfortable experience, which will make the excursion considerably more attractive.

According a preferred embodiment of the invention, the pleasure boat substantially comprises a jetted tub, one or more pumps for drawing the surrounding seawater, a system of ducts for the circulation of said seawater and one or more batteries for supply power to said pump(s).

Advantageously, said batteries can be integrated in the existing electrical system of the boat, if provided.

For example, in a pedal boat, the batteries used for feeding the drawing pumps can be the same already present in the assisted pedaling system.

Advantageously, said batteries can be charged by exploiting the boat propulsion system.

Still with reference to the example of the pedal boat, the batteries used can be connected to an electric generator connected to the pedals and can be charged by partially exploiting the mechanical energy of the pedaling.

Additionally or alternatively, photovoltaic panels can be provided on the boat for charging the aforesaid batteries.

SUMMARY DESCRIPTION OF THE FIGURES

Further characteristics and advantages of the invention will be clear from the following detailed description of several embodiments thereof, given as a non-limiting example with reference to the enclosed drawings, in which.

DESCRIPTION OF A PREFERRED EMBODIMENT

Figure 1:
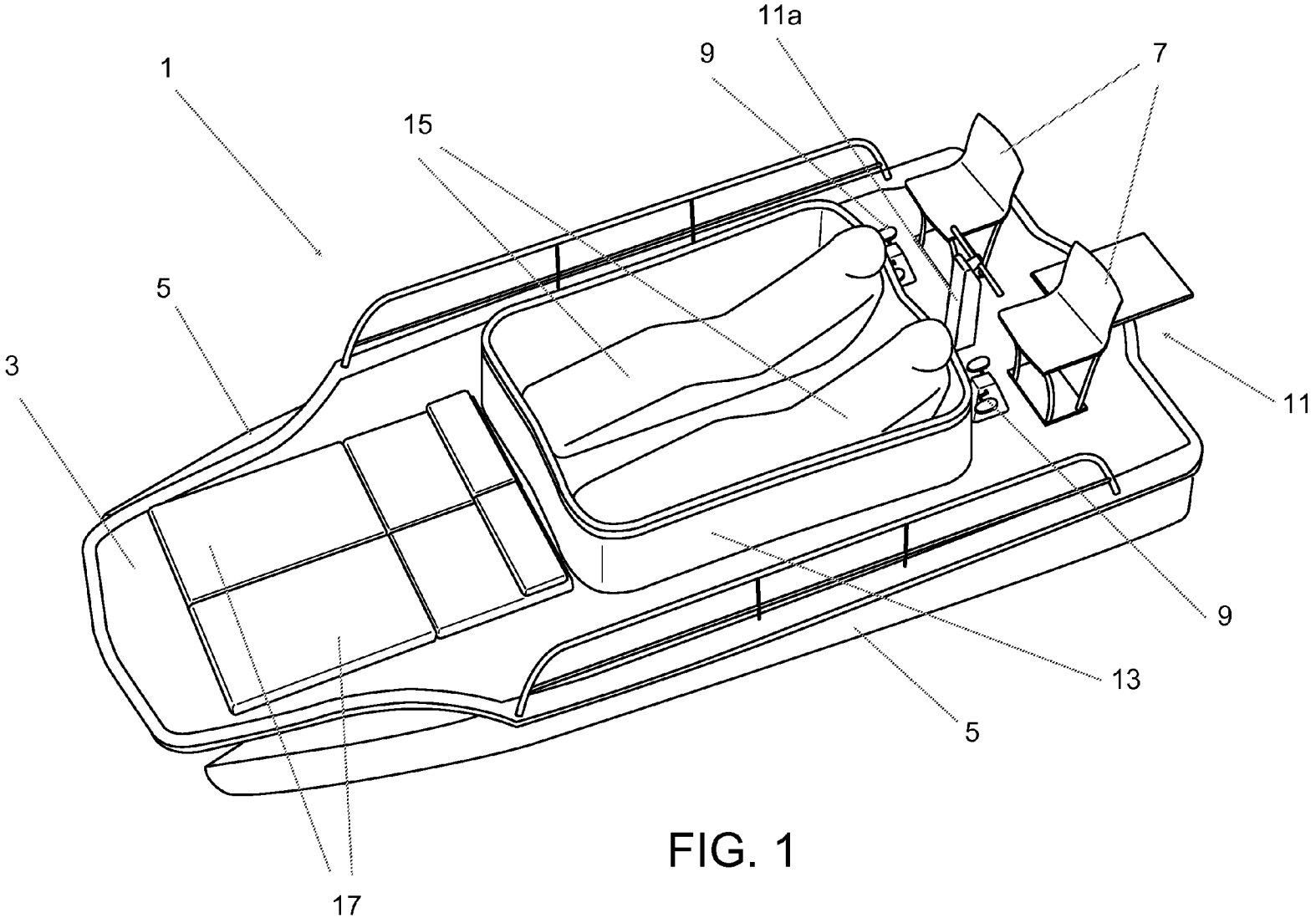
FIG. 1 is a perspective view that schematically illustrates a pleasure boat according to a first preferred embodiment of the invention.

With reference to FIG. 1, a pleasure boat is illustrated according to a first preferred embodiment of the invention, in particular a pedal boat 1.

The pedal boat 1 comprises, for example, a platform 3 mounted on a pair of equivalent and parallel hulls 5 that are spaced from each other.

On the platform 3, seats 7 are provided for the users—two in the illustrated embodiment—each at a respective pedal 9: by acting on the pedals 9, the users move a blade wheel (not visible) mechanically connected to said pedals and arranged between the hulls 5, causing the advancement of the pedal boat 1.

On the platform 3, a rudder 11 is also fixed, controlled by a bar 11*a*, which allows the pedal boat 1 to turn.

According to the invention, on the platform 3 of the pedal boat 1, a jetted tub 13 is also provided, in this case arranged in the central portion of the platform 3, in front of the seats 7 and the pedals 9 in the pedal boat 1 advancement direction.

As will be described in detail below, the jetted tub 13 is directly fed with seawater, which is drawn from the surrounding sea by means of one or more drawing pumps power supplied by electrical power supply means, e.g. batteries, and connected to the tub 13 by means of a suitable system of ducts for the circulation of the seawater.

Advantageously, in the jetted tub 13, one or more ergonomic positions 15 can be provided for further increasing user comfort.

In addition, as illustrated in FIG. 1, other accessories can be provided on the platform 3 intended to facilitate the wellbeing/comfort and relaxation of the user, such as one or more mattresses for tanning 17.

Figure 2:
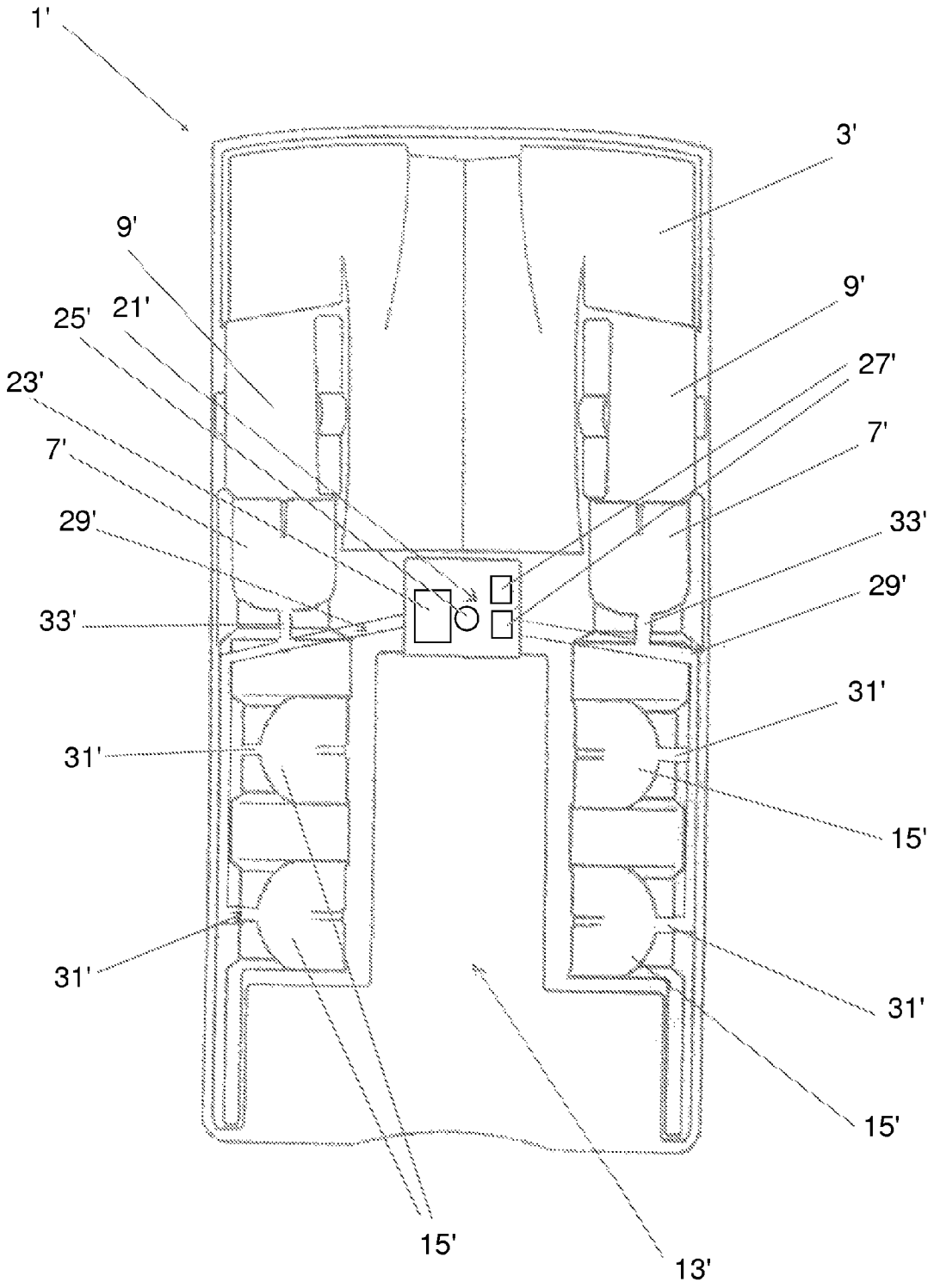
FIG. 2 is a top view that schematically illustrates a pleasure boat according to a second preferred embodiment of the invention.
Figure 3:
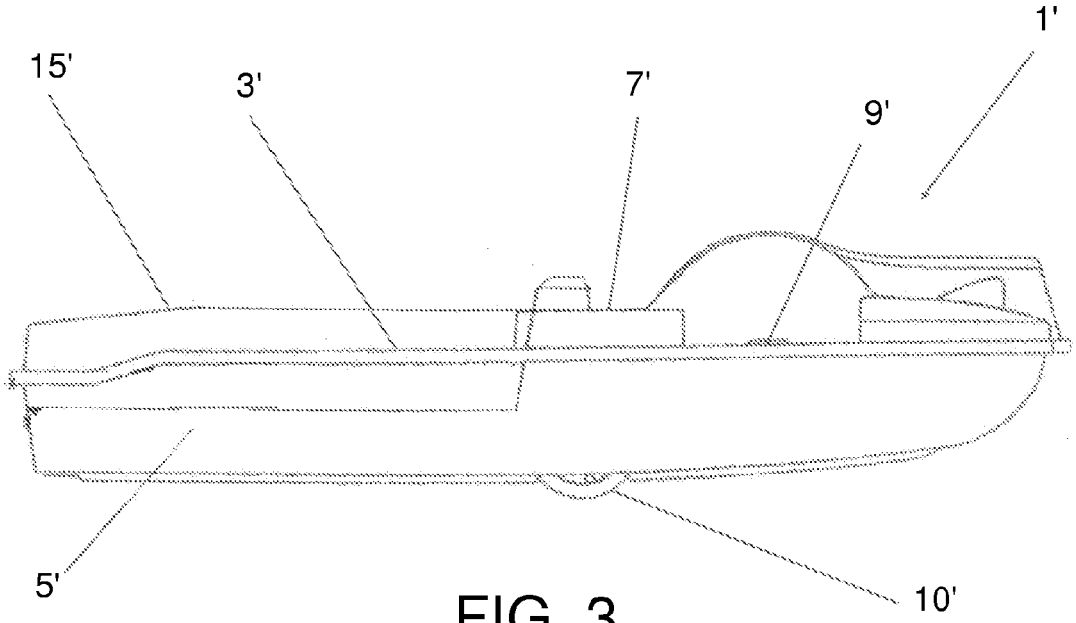
FIG. 3 is a side view that schematically illustrates the pleasure boat of FIG. 2.

The functioning of the invention will be illustrated in more detail with reference to FIGS. 2-4, which refer to a second preferred embodiment of the invention.

Also according to this second embodiment of the invention, the pedal boat 1' comprises a platform 3' mounted on a pair of equivalent and parallel hollow hulls 5' that are spaced from each other. On the platform 3', seats 7' are provided for the users—two in the illustrated embodiment—each at a respective pedal 9': by acting on the pedals 9', the users move a blade wheel 10' mechanically connected to said pedals and arranged between the hulls 5', causing the advancement of the pedal boat 1'.

On the platform 3' of the pedal boat 1', a jetted tub 13' is also provided, in this case arranged in the rear portion of the platform 3', behind the seats 7' in the advancement direction of the pedal boat 1.

Inside the tub 13', positions 15' are provided for the users, which in the illustrated embodiment are also in the form of seats.

The jetted tub 13' is directly fed with seawater, which is drawn from the surrounding sea through a suction tube 25' by means of a drawing pump 23' housed in a watertight compartment 21'.

The drawing pump 23' sucks seawater from the suction tube 25' and transports it through circulation ducts 29' terminating with outlet mouths 31' provided at the stations 15', so as to direct water jets on the users seated on said positions.

Advantageously, in the illustrated embodiment, the circulation ducts 29' provide for branches 33' that bring the water outside the tub 13' and direct water jets at the seats 7' where the users who use the pedals 9' are seated, such that these users also enjoy the beneficial water jets.

The drawing pump 23' is power supplied by electrical power supply means, e.g. batteries 27', also housed in the watertight compartment 21'.

Advantageously, in the case of electric pedal boats with assisted pedaling, the drawing pump 23' will be power supplied by the same batteries already provided on board the pedal boat for the assisted moving of the pedals 9'.

In addition, in a preferred embodiment of the invention, the batteries 27' can be connected to an electric generator connected to the pedals 9', in a manner such that the mechanical energy developed during the pedaling can be partially transformed into electrical energy and used to recharge said batteries.

Alternatively or additionally, photovoltaic panels can also be provided on the platform 3', these also used for recharging the batteries 27'. It is clear that the use of photovoltaic panels in seaside resorts, especially during the summer, is extremely advantageous.

Figure 4:
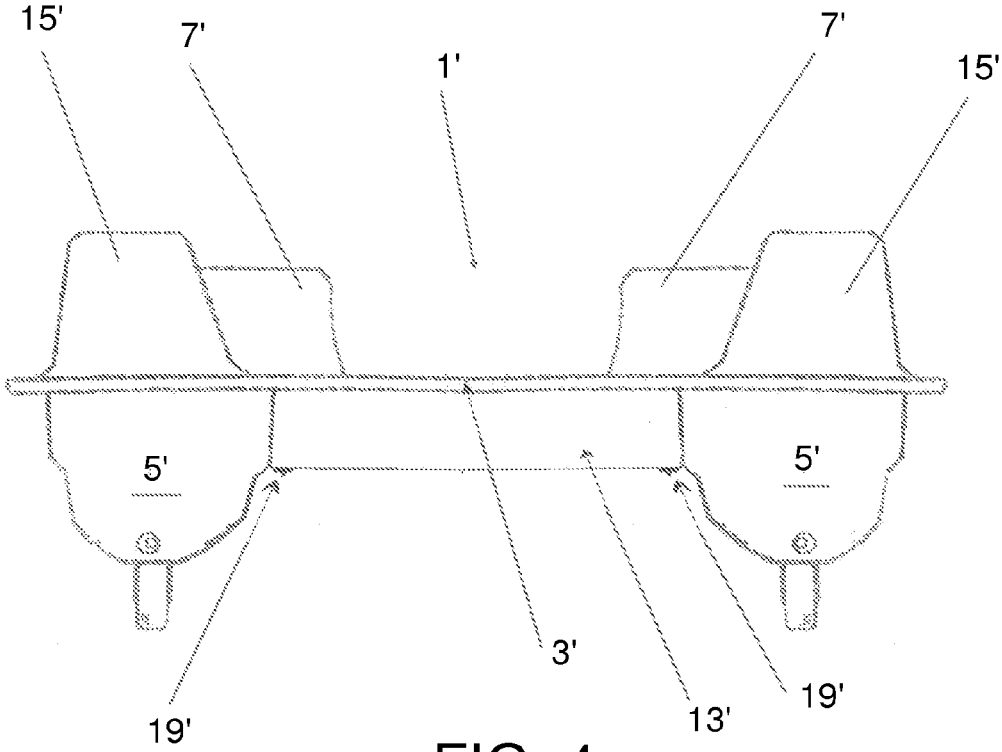
FIG. 4 is a rear cross section that schematically illustrates the pleasure boat of FIG. 2.

As illustrated for example in FIG. 4, the tub 13' is provided with plugs 19' for the emptying thereof, for example in order to remove salt and other impurities therefrom.

In an alternative embodiment of the invention, the jetted tub of the pedal boat can be arranged such that it can function even when the pedal boat is stopped at the waterline.

For such purpose, it will suffice to provide for the capability to selectively open or close the connection of the suction tube with the drawing pump, and simultaneously provide for a system of recirculation of the water present in the tub, which can be selectively connected to the drawing pump.

In such a manner, when the pedal boat is at sea, the suction tube will be connected to the drawing pump and the water recirculation system will be disconnected from said drawing pump; vice versa, when the pedal boat is at the waterline, the suction tube will be disconnected from said drawing pump and the recirculation system will be connected to said drawing pump, such that the jetted tub can continue to function with its own water.

From that described, it is clear that the invention attains the pre-established objects, since it provides a more comfortable pleasure boat with respect to analogous known boats.

It is also clear that the detailed description provided above was given for merely exemplifying purposes and variants are possible without departing from the protective scope defined by the claims set.

In particular, the invention is not limited to a pedal boat and the pleasure boat can be of different type, such as a rowboat, a dinghy, a sailboat or a motorboat, and it can comprise for example only one hull (rather than two).

Generally, if electrical power supply means are provided on the pleasure boat, the electrical power supply necessary for the functioning of the jetted tub will preferably be drawn from said existing means.

Moreover, it will generally be possible to provide that the electrical power supply necessary for the functioning of the jetted tub is at least partially obtained by exploiting the propulsion means of the pleasure boat.

The invention claimed is:

1. Pleasure boat comprising at least one hull, propulsion means arranged for moving the boat on the water; and a platform mounted on said at least one hull, said boat further comprising a jetted tub provided on said platform, said jetted tub having a water recirculation system; and a pump commanding device for driving surrounding water into said jetted tub;

wherein said pump commanding device comprises at least one suction tube arranged to draw water from the sea;

a plurality of circulation ducts terminating with outlet mouths directed towards a plurality of positions provided in said jetted tub;

a drawing pump connected to said suction tube, said drawing pump being arranged to suck water from the suction tube and transport the water through the circulation ducts to said plurality of positions provided in said jetted tub;

said drawing pump being selectively connectable to said suction tube or to said recirculation system;

so that when the drawing pump is connected to the suction tube, the water recirculation system is disconnected from said drawing pump, and when the suction tube is disconnected from said drawing pump the recirculation system is connected to said drawing pump and the jetted tub can continue to function with its own water;

and wherein said pleasure boat is a pedal boat having pedals and respective pedal seats, said circulation ducts terminating with further outlet mouths directed toward said pedal seats.

2. Pleasure boat according to claim 1, wherein said outlet mouths are directed towards respective positions in said boat corresponding to user seats.

3. Pleasure boat according to claim 1, wherein said boat also comprises electrical power supply means for supplying power to said drawing pump.

4. Pleasure boat according to claim 2, wherein said boat also comprises electrical power supply means for supplying power to said drawing pump.

5. Pleasure boat according to claim 3, wherein said electrical power supply means comprise one or more batteries.

6. Pleasure boat according to claim 3, wherein said electrical power supply means also supply power to the electric circuits provided on said boat.

7. Pleasure boat according to claim 3, wherein said electrical power supply means comprise an electric generator connected to said propulsion means of said boat, the mechanical energy developed by said propulsion means being converted into electrical energy for said electrical power supply.

8. Pleasure boat according to claim 3, wherein said electrical power supply means comprise one or more photovoltaic panels.

9. Pleasure boat according to claim 1, wherein said pedals are mechanically connected to a blade wheel for the propulsion of said pedal boat.

10. Pleasure boat comprising at least one hull, propulsion means arranged for moving the boat on the water; and a platform mounted on said at least one hull, said boat further comprising a jetted tub provided on said platform, said jetted tub having a water recirculation system; and a pump commanding device for driving surrounding water into said jetted tub;

wherein said pump commanding device comprises at least one suction tube arranged to draw water from the sea;

a plurality of circulation ducts terminating with outlet mouths directed towards a plurality of positions provided in said jetted tub;

a drawing pump connected to said suction tube, said drawing pump being arranged to suck water from the suction tube and transport the water through the circulation ducts to said plurality of positions provided in said jetted tub;

said drawing pump being selectively connectable to said suction tube or to said recirculation system;

so that when the drawing pump is connected to the suction tube, the water recirculation system is disconnected from said drawing pump, and when the suction tube is disconnected from said drawing pump the recirculation system is connected to said drawing pump and the jetted tub can continue to function with its own water; and wherein said pleasure boat is a rowboat.

11. Pleasure boat according to claim 1, wherein said pleasure boat is a dinghy.

12. Pleasure boat according to claim 1, wherein said pleasure boat is a sailboat.

13. Pleasure boat according to claim 1, wherein said pleasure boat is a motorboat.

14. Pleasure boat, comprising:

at least one hull, propulsion means arranged for moving the boat on the water; and a platform mounted on said at least one hull, said boat further comprising a jetted tub provided on said platform, said jetted tub having a water recirculation system; and a pump commanding device for driving surrounding water into said jetted tub;

wherein said pump commanding device comprises at least one suction tube arranged to draw water from the sea;

a plurality of circulation ducts terminating with outlet mouths directed towards a plurality of positions provided in said jetted tub;

a drawing pump connected to said suction tube, said drawing pump being arranged to suck water from the suction tube and transport the water through the circulation ducts to said plurality of positions provided in said jetted tub;

said drawing pump being selectively connectable to said suction tube or to said recirculation system;

so that when the drawing pump is connected to the suction tube, the water recirculation system is disconnected from said drawing pump, and when the suction tube is disconnected from said drawing pump the recirculation system is connected to said drawing pump and the jetted tub can continue to function with its own water; and wherein said pleasure boat is a pedal boat having pedals and respective pedal seats.

15. Pleasure boat according to claim 10, wherein said pleasure boat is a dinghy.

* * * * *